United States Patent [19]

Spier

[11] Patent Number: 4,995,173

[45] Date of Patent: Feb. 26, 1991

[54] HIGH TECH FOOTWEAR

[75] Inventor: I. Martin Spier, New York, N.Y.

[73] Assignees: Leonard Cooper; Judith Cooper, both of Pelham Manor, N.Y. ; a part interest

[21] Appl. No.: 337,265

[22] Filed: Apr. 13, 1989

[51] Int. Cl.[5] ..... A43B 13/20; A43B 7/06

[52] U.S. Cl. ..... 36/29; 36/93; 36/3 B; 36/114

[58] Field of Search ..... 36/93, 29, 3 R, 3 A, 36/3 B, 119, 71; 128/594; 280/611

[56] References Cited

U.S. PATENT DOCUMENTS

| | | | |
|---|---|---|---|
| 3,670,429 | 6/1972 | Androsiglio | 36/3 B |
| 3,973,336 | 8/1979 | Ahn | 36/3 B |
| 4,178,013 | 12/1979 | Bataille | 36/119 |
| 4,236,725 | 12/1980 | Bataille | 280/611 |
| 4,312,140 | 1/1982 | Reber | 36/3 B |
| 4,577,417 | 3/1986 | Cole | 36/29 |
| 4,583,305 | 4/1986 | Miyamoto | 36/93 |
| 4,631,893 | 12/1986 | Annovi | 36/119 |
| 4,702,022 | 10/1987 | Porcher | 36/119 |
| 4,712,316 | 12/1987 | Baggio | 36/93 |
| 4,730,403 | 3/1988 | Walkhoff | 36/119 |
| 4,763,426 | 8/1988 | Polus | 36/3 B |

FOREIGN PATENT DOCUMENTS

| | | | |
|---|---|---|---|
| 2321817 | 11/1973 | Fed. Rep. of Germany | 36/3 R |
| 2424716 | 11/1979 | France | 36/3 B |
| 2614510 | 11/1988 | France | 36/3 B |
| 8703789 | 7/1987 | PCT Int'l Appl. | 36/29 |
| 2189679 | 11/1987 | United Kingdom | 36/3 B |

*Primary Examiner*—Steven N. Meyers

[57] ABSTRACT

A shoe, boot, sneaker, etc. incorporates a foot-actuated pump which is connected to one or more expandable air bladders located in portions of the footware where contour fitting is desirable. Walking or running actuates the pump. An adjustable relief valve connected to the bladder releases air when a preselected pressure is exceeded. The relief valve is accessible externally for easy adjustment by the wearer. Regardless of the external ambient temperature or degree of user activity, the pump, in conjunction with the relief valve, maintains a preselected pressure and assures that the selected fit between the user's foot and footware is maintained at all times.

10 Claims, 1 Drawing Sheet

HIGH TECH FOOTWEAR

BACKGROUND OF THE INVENTION

This invention relates to shoes, and more particularly, to shoes which can be automatically adjusted in use to fit the users' foot under a wide range of usage and temperature conditions. For many years, the ski boot industry has tried to cope with the problem of comfortable fit for a boot. When the boots are cold, they are rather rigid and hard. When they heat up, they soften, which is the natural characteristics of thermoplastic material. Foam cushioning has been used as well as certain attempts which have been made to use an air-filled bladder within the shoes. Several years ago, a ski boot manufacturer used an air-filled inner boot which required an external pump to inflate the boot to an adequate pressure. This approach did not meet with commercial success, the problem being that a differential in temperature exists between indoor and outdoor conditions. Thus, a boot, or for another example, a sneaker, which is pumped up to fit indoors will be loose in colder outdoor temperatures. If the pressure is adjusted in the boot in a cold temperature and the person enters a warmer environment or, due to running, exercising, etc., heats up the air bladder within the footware, the footware becomes too tight as the pressure in the internal footware bladder builds up corresponding to the increased temperature.

In addition to this poor regulation of fit, it is necessary for the user to carry a pump in order to properly inflate the footware for the original fit.

What is needed is a high-tech boot, sneaker, or other footware which can be readily adjusted for proper fit with the user's foot, this adjustment being accomplished automatically and being automatically maintained regardless of changes in ambient conditions and degree of activity of the user.

SUMMARY OF THE INVENTION

Generally speaking, in accordance with the invention, high-tech footware especially suitable for providing and maintaining a good fit with the user by automatic means is provided. The shoe, boot, sneaker, etc. incorporates a foot-actuated pump preferably in the heel of the footware, which pump is connected to one or more expandable air bladders located in portions of the footware where contour fitting is desirable. For example, in a boot, the bladder can be located where it encircles the ankle.

The pump is of the bellows type, having a small chamber with an inlet permitting one way flow from the external ambient into the pump chamber and an outlet permitting only one way flow from the chamber. The chamber outlet connects to the one or more bladders, for example, the ankle loop bladder and pressurizes the bladder when the user, in normal walking or running, actuates the bellows portion of the pump. The bellows are resilently incorporated in the heel such that when the user's weight is not exerted on the heel, the bellows expand drawing air into the bellows through the one way inlet. When the user walks or runs or otherwise exerts force or weight which compresses the bellows, the air is expelled from the pump to the bladder.

An adjustable relief valve connected to the bladder releases air therefrom when a pre-selected pressure is exceeded. The relief valve is accessible externally of the footware for easy adjustment by the user. Thus, substantially every step or stride by the user pumps fresh air into the bladder while, at the same time, old air within the bladder is expelled through the relief valve. Regardless of the external ambient temperature or the degree of activity of the user, the pump operating in conjunction with the relief valve maintains a preselected pressure and assures that the selected fit between the user's foot and the footware is maintained at all times. Air pressure in the bladder is readily released by the user who actuates a valve connecting the bladder to the external environment.

In alternative embodiments in accordance with the invention, the bladder need not be pressurized to a predetermined level but air is circulated to particularly selected portions of the footware for ventilation purposes by automatic operation of the pump, as described.

Accordingly, it is an object of this invention to provide an improved high-tech footware which allows for automatic adjustment of the fit to the user and maintains such fit.

Another object of this invention is to provide improved high-tech footware which automatically provides forced ventilation over selected portions of the foot.

A further object of this invention is to provide high-tech footware which automatically adjusts for proper fit with the user and also provides forced ventilation for the foot.

Still other objects and advantages of the invention will in part be obvious and will in part be apparent from this specification.

This invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figures 1, 2, 3, 4, 5:
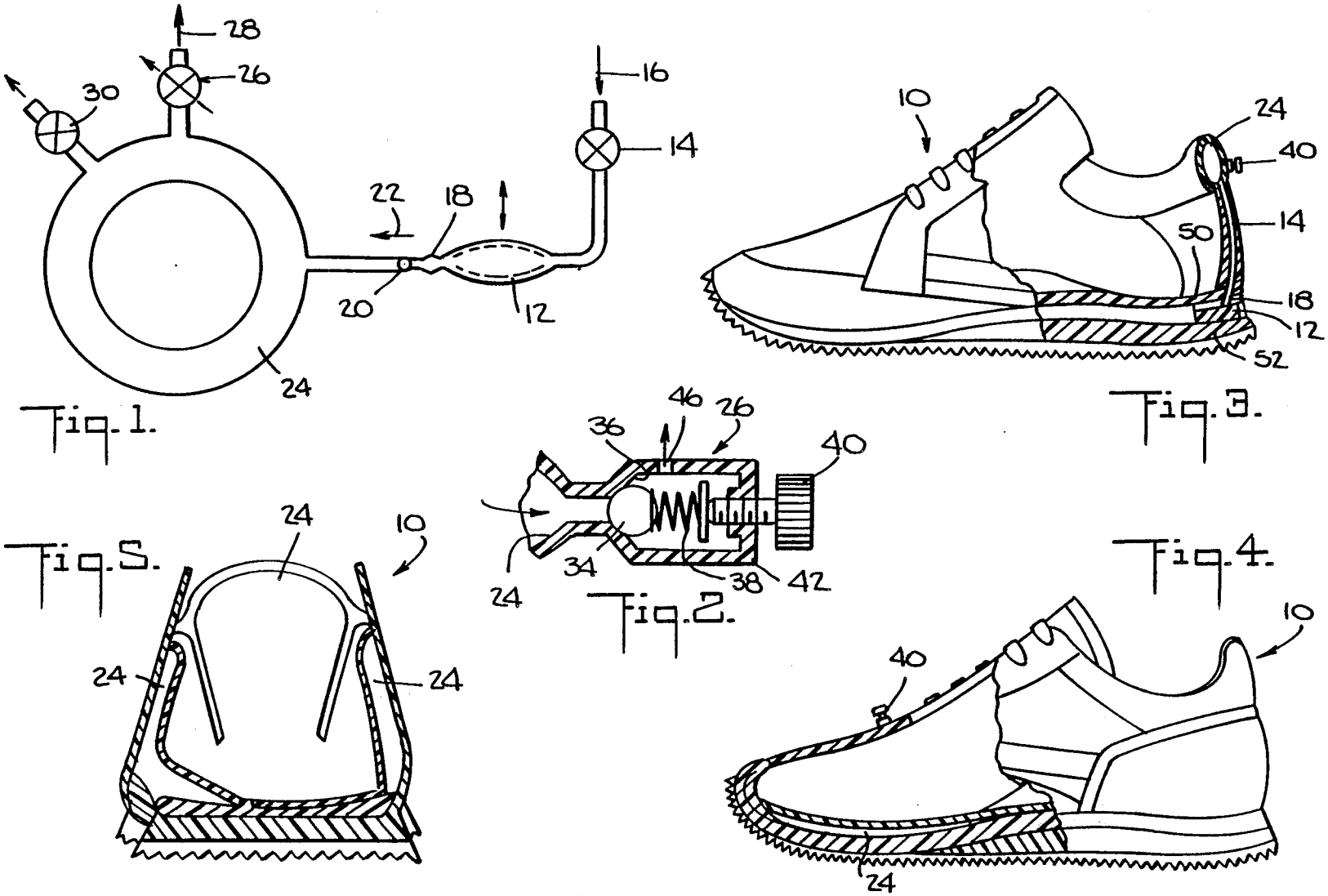
FIG. 1 is a diagram of a pneumatic circuit in accordance with the invention.
FIG. 2 is an adjustable automatic pressure relief valve from the circuit of FIG. 1.
FIG. 3 is a side elevational view, partially cut away, of a sneaker including the pneumatic circuit of FIG. 1.
FIG. 4 is a view similar to FIG. 3 of another embodiment of a sneaker in accordance with the invention.
FIG. 5 is an end elevational view in section of a sneaker in another alternative embodiment of the invention.

With reference to the Figures, the footware 10 in accordance with the invention includes a pump 12 having an air inlet valve 14 which allows flow therethrough only in the direction indicated by the arrow 16. The pump has an outlet 18 controlled by an outlet valve 20 which permits flow only in the direction indicated by the arrow 22. The pump outlet 18 is connected to a bladder 24 which inflates with air when the pump 12 operates. An adjustable pressure relief valve 26 connects to the internal volume of the bladder and releases air in the direction indicated by the arrow 28 whenever the air pressure within the bladder 24 exceedes a preselected level.

The pump 12 can be of any type capable of external actuation, however, in a preferred embodiment for use in a shoe, boot, sneaker, etc., a bellows type pump 12 is used. In the arrangement of FIG. 1, whenever the walls of the bellows pump 12 are compressed together, that is, moved toward each other, air within the bellows is expelled through the outlet 18 and enters the bladder 24. When the bellows are compressed, the inlet valve 14 prevents backflow in a direction opposite to the arrow 16 to the ambient environmnet. When the bellows of the pump are allowed to expand, that is the walls separate, such that a vacuum tends to be created within the bellows, the valve 14 automatically opens to allow a flow of air in the direction of the arrow 16 from the external environment into the pump 12. At the same time that air enters the pump through the inlet valve 14, the outlet valve 20 prevents backflow of pressurized air from the bladder 24 into the chamber of the pump 12.

In an alternative embodiment in accordance with the invention, the outlet valve 20 may be eliminated when the restriction in the oulet 18 is far greater than the restriction presented by the inlet valve 14. In such an embodiment, when the bellows of the punmp 12 expand to take in air, more air will enter through the valve 14 than flows out of the bladder 24 to the pump.

A release valve 30 is manually operated when the user wishes to discharge the air from the bladder 24 to facilitate removal of the footware from the user's foot.

The one way valving devices 14, 20, 26 of FIG. 1 may be implemented in many ways which will be apparent to those skilled in the art. For examples, the valves 14, 20 may be simple flapper-type valves such as are used, for example, on water wings and on floats for children. Therein, one resillent flap overlays the other and allows flow of air in only one direction. To open the valve, all that is needed is a pressure differential in the flow direction. To the contrary, when the pressure differential is in the other direction, the flaps of the valve seal against each other.

Also, in another example as illustrated, the valve 20 has a ball for the closing device. The ball seats against the conical surface when the pressure is high in the bladder 24 and lower in the pump 12. When the pressure in the pump 12 is higher than in the bladder 24, the ball lifts from the conical seat and allows air to flow around the ball to the bladder.

In the illustrated embodiment, the adjustable one way pressure relief valve 26 includes a ball 34 held against a conical seat 36 by the force of a spring 38. The spring 38 is compressed between an adjustment screw 40 and the ball 34. The adjustment screw 40 is threaded into a housing 42. By turning the screw 40, the force of the spring 38 against the ball 34 can be varied. In this way, the pressure in the bladder 24 which will cause the ball 34 to lift from the conical seat 36 is varied. When the ball 34 lifts from the conical seat 36, air from the bladder 24 flows around the ball 34 and escapes from the housing 42 through a side vent 46. Turning the adjustment screw 40 such that the spring is further compressed, increases the pressure in the bladder 24 which must be exceeded before the valve 26 opens to vent air.

As stated, the valving in the circuit of FIG. 1 may be accomplished in many ways by those skilled in the art. Thus the above valve descriptions are illustrative and should not be considered as limiting.

FIG. 3 is a sneaker of conventional construction except for inclusion therin of the elements of the pneumatic circuit of FIG. 1. Therefore a detailed description of the sneaker is omitted herein. In the sneaker 10 the bellows pump 12 is incorporated into the heel of the shoe. The bladder 24, which can be of any shape desired to suit its location, is here located as a horseshoe-shaped cuff in the ankle region of the sneaker 10. Simply stated, the bladder 24 need not be the donut shape shown in FIG. 1.

The air inlet valve 14 is located above the heel so as to reduce the possibility of drawing water and dust into the bladder 24 from the ground surface where the user steps. The adjustment screw 40 is at the back of the shoe 10 above the heel. The tubing between the inlet and outlet valves is indicated generally in FIG. 3. The pump 12 is craddled between the inner foot supporting surface 50 of the sneaker and a sole flap 52. The sole flap 52 is effectively cantilevered out beyond the main sole such that flexure increases as the distance from the main sole increases when the user steps down on the heel, the pump 12 with its bellows construction, is compressed. As stated above, when the pump bellows is compressed air enters the bladder 24.

Thus, when a person puts on the shoe, a few steps will commence inflation of the bladder 24. The user adjusts, or has pre-adjusted, the adjustment screw 40 for a pressure which gives comfort around his ankles. After that pressure is achieved in the bladder, his further actions will drive the pump to add new air into the bladder 24 while at the same time excessive pressure in the bladder 24 is relieved by automatic operation, that is opening, of the one way relief valve 26 to expel air to the ambient via the vent 46.

FIG. 4 illustrates a shoe similar to that of FIG. 3 where the bladder 24 is located in the sole area of the shoe. The pump 12 and air inlet again may be in the heel region. The relief valve 26 with the adjustment screw 40 are in the region of the instep.

In FIG. 5, a sectional view looking from the rear toward the front of the shoe, the air bladder(s) 24 appears on the sides of the shoe and in the tongue. In all embodiments there may be more than one bladder 24 and valving may be appropriately provided such that each bladder can be individually controlled for its pressure or a single relief valve 26 can serve when all bladders are interconnected.

In an alternative embodiment (not shown) in accordance with the invention, the relief valve 26 can be omitted. In such construction, air is circulated through the shoe and where some restriction is provided at the outlet where the valve 26 has been removed, a degree of pressurization of the bladder will also be provided. Further, the bladder may be formed of semi-permeable material such that air delivered by the pump 12 passes through the bladder wall and ventilates the foot, the air escaping the shoe interstitially through any available crevices and spaces, which are always present. In such a case, the valve 26 may be omitted and the bladder is provided with no discharge opening except by virtue of its porosity.

Also, in yet another embodiment of the invention, the pressure releif valve 26 may be used with a bladder construction which is semi-porous such that ventilation is provided within the shoe while at the same time the bladder is pressurized to a selected level and maintained there by the valve 26 for the sake of good fit In another alternative embodiment, the bladder is made of a material which is semi-permeable, allowing moisture to migrate from the foot area into the bladder while at the same time air from the bladder can escape only through the vent valve 26. In such a construction, pressurization is maintained for fit of the shoe to the user and dehumidification in the foot regions is provided.

Such shoes which provide for any or all of foot ventilation, foot drying, and adjustable fitting of the shoe to the user can be highly advantageous for people who must do considerable amounts of walking, standing or running, for example, those in military service, mail delivery personnel, messengers, etc.

It should further be understood that the pump 12 need not be located in the heel region of the shoe but may also be placed in the sole area, for example, near the ball of the foot. Basically, the pump must be located where the user's motion and weight are available for actuating the pump in performance of its air delivery task. Applications of the concepts contained herein to other fields, for example, for automatically maintaining the pressure in automotive vehicle tires, are entirely possible.

It will thus be seen that the objects set forth above, among those made apparent from the preceeding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In footwear having a toe end and a heel end and having an outer sole extending from said toe end toward said heel end, said outer sole having an exterior surface for contact with the ground, and said footwear having an upper portion connected to said sole forming an enclosure for enclosing at least a part of the foot of a wearer between the outer sole and the upper portion, and within said enclosure an inner supporting surface for supporting the bottom of a foot, said inner supporting surface extending from the heel end toward said toe end, the improvement therein comprising:

bladder means for holding air, said bladder means being positioned at least partially within said enclosure;

pumping means including a compressible chamber for delivering outside ambient air to said bladder means by flexing said chamber, said pumping means being at least in part located in a hollow space at said heel end, said hollow space being between said inner supporting surface and said exterior surface of said footwear, a flexible segment extending from a main portion of said sole and forming a surface of said hollow space and a portion of said exterior surface and having two ends, one said end being closer to said toe end of said footwear and connected to said main sole portion, said segment being subject to deflection by a force applied to said segment exterior surface, whereby said hollow space may be alternately reduced and returned to its unreduced size, in flexing in response to said force, the degree of flexure of said segment increasing as the distance from said main sole portion increases, said segment flexing said chamber to deliver said air.

2. Footwear as in claim 1, wherein said flexible sole segment is cantilevered on said main sole portion.

3. Footware as claimed in claim 1 wherein said bladder means is at least in part expandable as air is received from said pumping means, and further comprising a pressure relief valve connected to said bladder means, said relief valve opening when air pressure within said bladder means exceeds a predetermined level, the pressure within said bladder means being maintained substantially constant while said pumping means continues to deliver ambient air to said bladder means.

4. Footwear as claimed in claim 3, wherein said pumping means include a pump, at least partially within said hollow space and having an inlet adapted to receive said outside ambient air, and an outlet connected to said bladder means for delivery of pumped air thereto.

5. Footwear as claimed in claim 3, wherein said pressure relief valve includes adjustable means for releasing air from said bladder means at different internal bladder means pressures, said predetermined pressure being selectable by the wearer of the footware.

6. Footwear as claimed in claim 5, wherein said adjustable means is accessible to said wearer on an external portion of said footware.

7. Footwear as claimed in claim 5, wherein said adjustable means is manually operable.

8. Footwear as claimed in claim 1, wherein said pumping means includes a pump within said hollow space having an inlet adapted to receive outside ambient air, and an outlet connected to said bladder means for delivering said pumped air thereto.

9. Footwear as claimed in claim 1, wherein said pumping means includes an inlet and an outlet, said inlet includes flow control means for preventing air flow from said pump out of said inlet, and said pumping means outlet includes flow control means for preventing backflow from said bladder means.

10. Footwear as claimed in claim 1, wherein said bladder means includes a plurality of individual bladders, each bladder being at least partially within said enclosure.

* * * * *